US007655068B2

(12) United States Patent
Johnston et al.

(10) Patent No.: US 7,655,068 B2
(45) Date of Patent: Feb. 2, 2010

(54) METHOD AND SYSTEMS TO FACILITATE IMPROVING ELECTROSTATIC PRECIPITATOR PERFORMANCE

(75) Inventors: David Johnston, Poquoson, VA (US); James Easel Roberts, Kansas City, MO (US); Robert Warren Taylor, Ponte Vedra Beach, FL (US); Yingneng Zhou, Niskayuna, NY (US); Abdelkrim Younsi, Ballston Lake, NY (US); Jennifer Lynn Molaison, Marietta, GA (US); Wei Wu, Canton, MI (US)

(73) Assignee: General Electric Company, Schenectady, NY (US)

( * ) Notice: Subject to any disclaimer, the term of this patent is extended or adjusted under 35 U.S.C. 154(b) by 362 days.

(21) Appl. No.: 11/763,195

(22) Filed: Jun. 14, 2007

(65) Prior Publication Data

US 2008/0307974 A1 Dec. 18, 2008

(51) Int. Cl.
*B03C 3/68* (2006.01)

(52) U.S. Cl. ..... 95/6; 95/7; 96/22; 96/23; 96/24

(58) Field of Classification Search ..... 95/2–7; 96/18–24; 323/903
See application file for complete search history.

(56) References Cited

U.S. PATENT DOCUMENTS 2,042,181 A * 5/1936 Knowles ..... 96/22
2,881,855 A * 4/1959 Klemperer ..... 96/21
3,049,848 A * 8/1962 Klemperer ..... 96/23
3,740,926 A 6/1973 Duval
4,244,709 A 1/1981 Chang
4,311,491 A * 1/1982 Bibbo et al. ..... 95/7
4,648,887 A * 3/1987 Noda et al. ..... 95/7
4,654,772 A * 3/1987 Thorne ..... 363/19
4,808,200 A * 2/1989 Dallhammer et al. ..... 95/6
4,936,876 A * 6/1990 Reyes ..... 95/6
4,966,610 A 10/1990 Krigmont et al.
5,282,891 A 2/1994 Durham
5,378,978 A * 1/1995 Gallo et al. ..... 323/241
5,471,377 A * 11/1995 Donig et al. ..... 95/5
5,567,226 A 10/1996 Lookman et al.
5,707,422 A * 1/1998 Jacobsson et al. ..... 95/6
5,922,103 A 7/1999 Schwab et al.
5,980,610 A 11/1999 Huang et al.
6,363,869 B1 4/2002 Ashworth (Continued)

FOREIGN PATENT DOCUMENTS

GB 2096845 A * 10/1982 ..... 96/21

(Continued)

*Primary Examiner*—Richard L Chiesa
(74) *Attorney, Agent, or Firm*—Armstrong Teasdale LLP

(57) ABSTRACT

A method to facilitate improving electrostatic precipitator performance is provided. The method includes providing an electrostatic precipitator including an inlet, a collector chamber and an outlet, where the collector chamber includes a plurality of discharge electrodes and a plurality of collector electrodes. The method also includes defining a respective discharge electrode V-I performance for each of the plurality of discharge electrodes, identifying a particle removal characteristic for each respective discharge electrode based on the respective discharge electrode V-I performance for each of the plurality of discharge electrodes and positioning each of the plurality of discharge electrodes in the electrostatic precipitator according to the particle removal characteristic for each respective discharge electrode.

14 Claims, 4 Drawing Sheets

U.S. PATENT DOCUMENTS

| | | | | |
|---|---|---|---|---|
| 6,540,812 | B2 | 4/2003 | Farmer et al. | |
| 6,797,035 | B2 | 9/2004 | Baldrey et al. | |
| 7,497,893 | B2 * | 3/2009 | Krichtafovitch | 95/2 |
| 2001/0011499 | A1 * | 8/2001 | Reyes | 95/7 |

FOREIGN PATENT DOCUMENTS

| | | | | |
|---|---|---|---|---|
| JP | 61-25650 A * | 2/1986 | | 95/7 |

* cited by examiner

-- PRIOR ART --

-- PRIOR ART --

METHOD AND SYSTEMS TO FACILITATE IMPROVING ELECTROSTATIC PRECIPITATOR PERFORMANCE

BACKGROUND OF THE INVENTION

This invention relates generally to electrostatic precipitators, and more particularly, to methods of improving electrostatic precipitator performance.

Known electrostatic precipitators remove particles from gas and are generally used in industrial applications. At least some known methods of determining electrostatic precipitator performance are based on current density ($A/m^2$). Generally the current density may be determined by measuring the electrons bridging a gap between emitting electrodes and sets of collecting electrodes. Electrode operating voltage may be variable because of the buildup of dust or contaminant particles on the collecting plates or the emitting electrodes.

Known emitting electrodes have an associated electric field, are positioned at least at the precipitator input and output, and may be designed to generate the most possible current for any given situation. The electric fields of properly functioning discharge electrodes located at the precipitator inlet may capture significantly more contaminant particles than electric fields of properly functioning discharge electrodes located at the precipitator outlet. As such, electric fields at the inlet may need to overcome a space charge caused by a huge number of particles collected between the emitting and collecting electrodes. Generally, electric fields at the outlet may be subjected to significantly fewer particles, so electrons migrate much easier. Because it is easier to have high current densities in an electric field at the precipitator output than in an electric field at the precipitator input, it may be difficult to impart power to an electric field at the input and it may be easier to impart excessive power to an electric field at the output.

Electrostatic precipitators may not fully use their power supplies. For example, mismatched impedance may prevent the power supply from reaching secondary design limits. This may result in operating voltages of about 10-20% lower than rated voltage, while the input power may be at its operating limit. The opposite may also occur. Should the sparking rate remain the same, minimally increasing or decreasing the system impedance may increase the total wattage input to the electric field, which may improve overall precipitator performance.

Known discharge electrodes are generally not designed to match the impedance of their associated electric fields. Rather, they are generally designed to facilitate maximizing the power in their associated electric fields. Measuring and optimizing watts may provide the best impedance matching.

BRIEF DESCRIPTION OF THE INVENTION

In one aspect, a method to facilitate improving electrostatic precipitator performance is provided. The method includes providing an electrostatic precipitator including an inlet, a collector chamber and an outlet, where the collector chamber includes a plurality of discharge electrodes and a plurality of collector electrodes. The method also includes defining a respective discharge electrode V-I performance for each of the plurality of discharge electrodes, identifying a particle removal characteristic for each respective discharge electrode based on the respective discharge electrode V-I performance for each of the plurality of discharge electrodes and positioning each of the plurality of discharge electrodes in the electrostatic precipitator according to the particle removal characteristic for each respective discharge electrode.

In another aspect, a system for improving electrostatic precipitator performance is provided. The system includes an electrostatic precipitator including an inlet, an outlet and a collector chamber extending between the inlet and the outlet. The collector chamber includes a plurality of discharge electrodes and a plurality of collector electrodes and a respective discharge electrode V-I performance, related to a respective discharge electrode geometry associated for each of the plurality of discharge electrodes. Each of the discharge electrode V-I performances is used to identify a particle removal characteristic for each respective discharge electrode and each of the plurality of discharge electrodes is positioned in the electrostatic precipitator based on the particle removal characteristic for each respective discharge electrode.

In yet another aspect, an apparatus to facilitate matching impedance of discharge electrodes in electrostatic precipitators is provided. The apparatus includes an electrostatic precipitator including an inlet, a collector chamber and an outlet, the collector chamber includes a plurality of discharge electrodes and a plurality of collector electrodes, wherein a relationship between a secondary voltage and a secondary current is determined by at least one discharge electrode geometry.

DETAILED DESCRIPTION OF THE INVENTION

Figure 1:
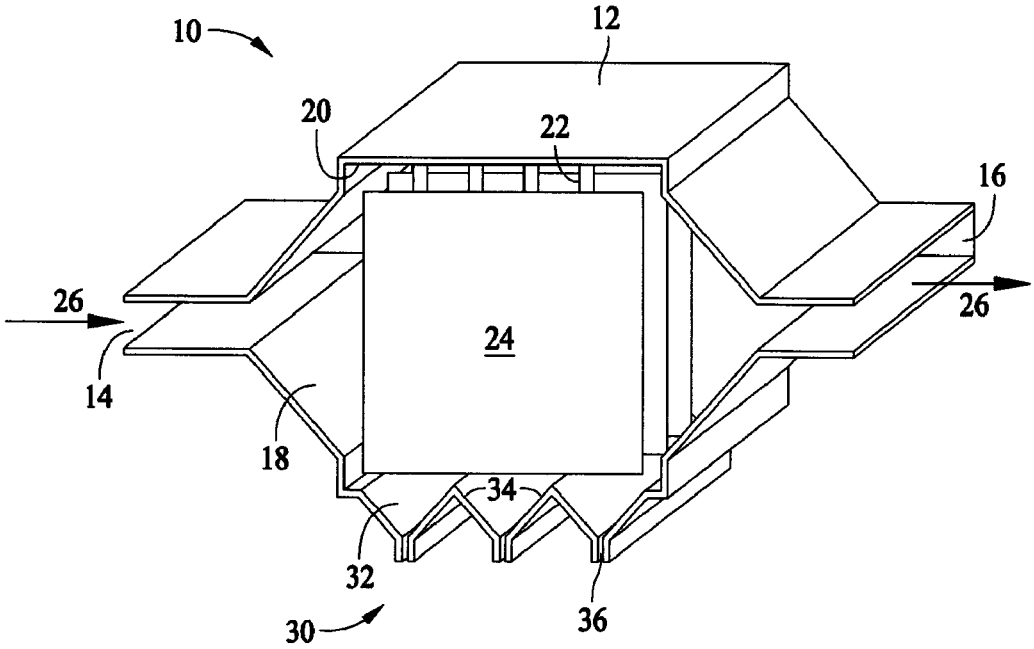
FIG. 1 is a perspective view of a known exemplary electrostatic precipitator.
Figure 2:
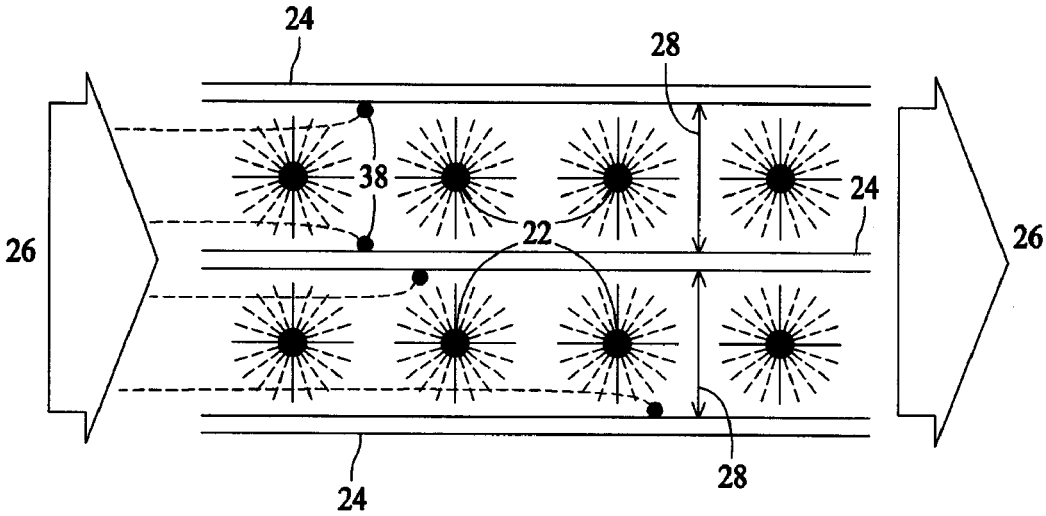
FIG. 2 is a top cross-sectional view of the known exemplary electrical precipitator shown in FIG. 1.

FIG. 1 is a perspective view of an exemplary electrostatic precipitator 10. FIG. 2 is a top cross-sectional view of electrostatic precipitator 10. In the exemplary embodiment, precipitator 10 includes a body 12 that has an entry channel 14, an exit channel 16 and a collector chamber 18 positioned between entry channel 14 and exit channel 16. Collector chamber 18 includes an inner top surface 20 and a plurality of rigid discharge electrodes 22 that each extend from surface 20. Collector chamber 18 also includes a plurality of collector electrodes 24 that are suspended from inner surface 20. Electrodes 24 are positioned within a flow path 26 that extends from entry channel 14 through collector chamber 18 and to exit channel 16.

In the exemplary embodiment, Collector electrodes 24 are square plates that are positioned substantially parallel to, and uniformly spaced from, each other such that a gap 28 is defined between adjacent electrodes 24. Each of the plurality of discharge electrodes 22 extends from surface 20 into gap 28 between adjacent collector electrodes 24. Furthermore, collector chamber 18 includes a bottom surface 30 that includes a plurality of sloughing channels 32 that are positioned above a hopper (not shown). Each sloughing channel 32 includes at least two sides 34 that slope towards an exit passage 36. It should be appreciated that although collector electrodes 24 are described as square plates, collector electrodes 24 may be any collector electrode, that enables electrostatic precipitator 10 to function as described herein, such as, but not limited to, plain wire, barbed wire, spiral wire, twisted round wire, twisted square wire, thin metal sheets cut with points and a tube with various styles of pins, barbs, projections or edges.

During operation, fluid containing suspended particles 38 is channeled through entry channel 14 into collector chamber 18. The fluid channeled along flow path 26 between collector electrodes 24. Rigid discharge electrodes 22 are charged with a high current, creating a corona of electrons and an associated electric field which ionizes suspended particles 38 causing particles 38 to migrate towards collector electrodes 24. Generally, discharge electrodes 22 have a negative potential and collector electrodes 24 have a positive potential. As such, rigid discharge electrodes 22 charge suspended particles 38 and collector electrodes 24 collect suspended particles 38. It should be appreciated that the term "fluid" as used herein includes any material or medium that flows, including but not limited to, gas, air and liquids.

Because a plurality of discharge electrodes 22 extend into collector chamber 18, collector chamber 18 is divided into a plurality of electric fields that are each defined by a corresponding discharge electrode 22. Moreover, it should be appreciated that the impedance of each electric field is a function of the amount of dust in the electric field.

It should be understood that precipitator performance is optimized when power is maximized. More specifically, matching the impedance of each rigid discharge electrode 22 with the impedance of its associated electric field facilitates maximizing the total power, in watts, input to its associated electric field. It should be appreciated that matching the impedance of each rigid discharge electrode 22 with the impedance of its associated electric field is accomplished by altering the geometry of each rigid discharge electrode 22. Altering the geometry of each rigid discharge electrode 22 also modifies the relationship between a secondary voltage and a secondary current. For example, the geometry of each rigid discharge electrode 22 may be altered by adjusting a pin length, pin spacing, tube diameter and pin angle.

A voltage is applied to each discharge electrode 22, and when a pre-determined voltage is applied a corona begins to develop and a secondary current begins to develop between discharge electrode 22 and collector electrode 24. Corona onset voltage is defined as the point at which measurable secondary current is first observed. After the corona onset voltage is reached, for each increase in the applied voltage there is an increase in the secondary current. It should be understood that applied voltages exceeding the corona onset voltage are considered secondary voltages. Moreover, it should be understood that for a given rigid electrode geometry and fluid conditions, the applied secondary voltage drives the level of secondary current realized. In addition, discharge electrodes each have a V-I performance curve determined by plotting applied secondary voltage versus measured secondary current. In electrodes, the current is dependent and increases exponentially with the voltage, and maximizing the secondary voltage may optimize precipitator performance.

Figure 3:
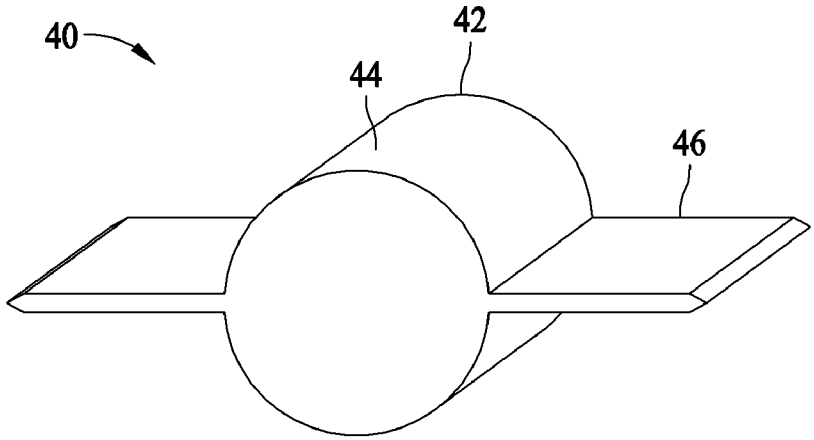
FIG. 3 is a perspective view of an exemplary dual blade discharge electrode.

FIG. 3 is a perspective view of an exemplary dual blade discharge electrode 40. More specifically, dual blade discharge electrode 40 includes a central discharge electrode body 42 having an outer surface 44 and two blades 46 extending radially outward therefrom. In the exemplary embodiment, electrode body 42 is cylindrically-shaped and has a substantially circular cross-section. Blades 46 are positioned about outer surface 44, extend generally radially outward from surface 44, and are diametrically opposed to each other. It should be appreciated that although the exemplary embodiment is described as including an electrode body 42 having a substantially circular cross-section, in other embodiments, electrode body 42 may have any cross-sectional shape that enables discharge electrode 40 to function as described herein.

Figure 4:
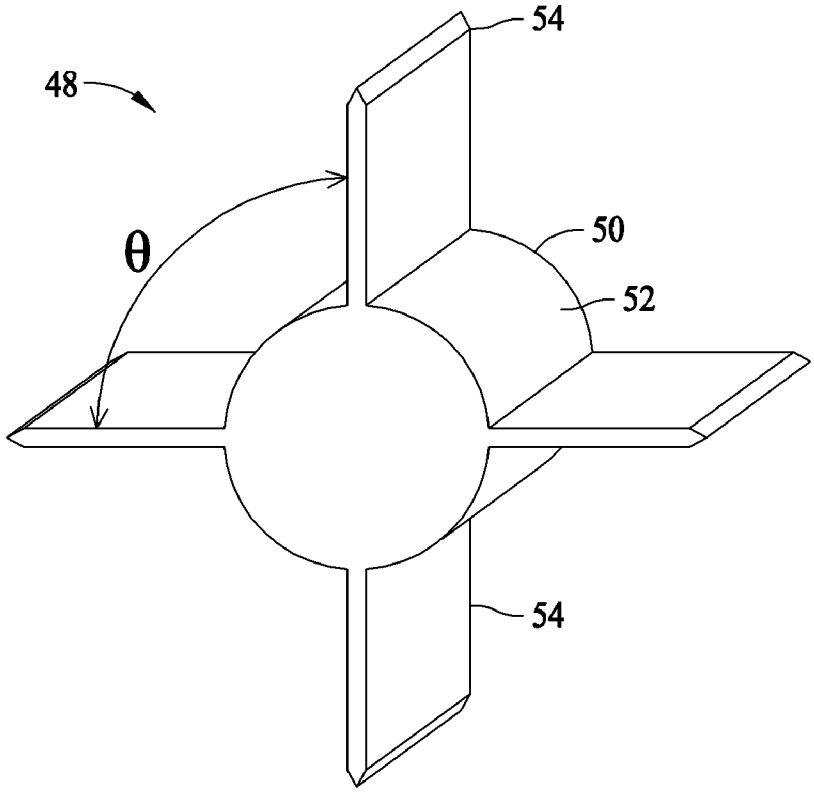
FIG. 4 is a perspective view of an exemplary quad blade discharge electrode.

FIG. 4 is a perspective view of an exemplary quad blade discharge electrode 48. More specifically, dual blade discharge electrode 48 includes a central discharge electrode body 50 having an outer surface 52 and four blades 54 extending radially outward therefrom. In the exemplary embodiment, electrode body 50 is cylindrically-shaped and has a substantially circular cross-section. Blades 54 are positioned about the periphery of outer surface 52, are separated by an angle $\theta$ of approximately ninety degrees and extend generally radially outward from outer surface 52. It should be appreciated that although the exemplary embodiment is described as including an electrode body 50 having a substantially circular cross-section, in other embodiments, electrode body 50 may have any cross-sectional shape that enables discharge electrode 48 to function as described herein. Moreover, it should be appreciated that angle $\theta$ between blades 54 may be any angle $\theta$, not necessarily equal, that enables discharge electrode 48 to function as described herein.

Figure 5:
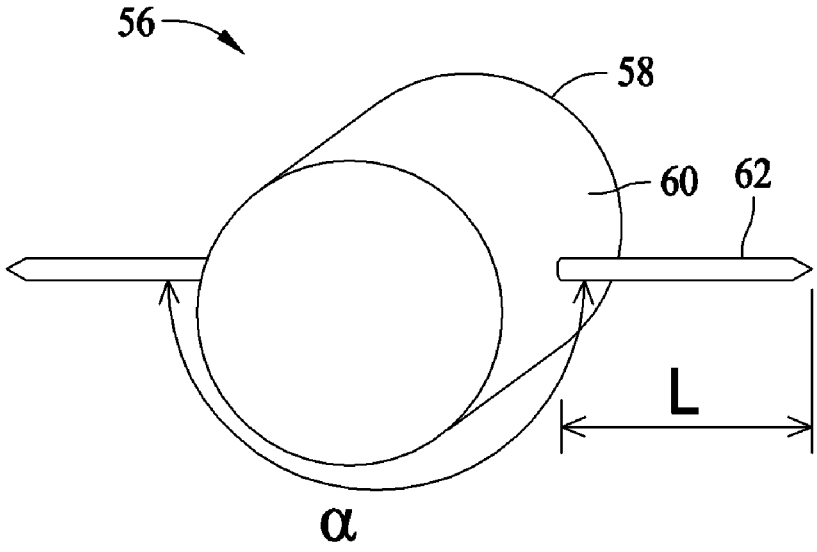
FIG. 5 is a perspective view of an exemplary opposed pin discharge electrode.

FIG. 5 is a perspective view of an exemplary opposed pin discharge electrode 56. More specifically, opposed pin discharge electrode 56 includes a central discharge electrode body 58 having an outer surface 60 and two pins 62 extending radially outward therefrom. Electrode body 58 is cylindrically-shaped and has a substantially circular cross-section. Pins 62 have a length L of approximately 1½ inches, are positioned at an angle $\alpha$ of approximately one hundred eighty degrees from each other about the periphery of outer surface 60 and extend radially outward from outer surface 60. It should be appreciated that although the exemplary embodiment is described as including an electrode body 58 having a substantially circular cross-section, in other embodiments, electrode body 58 may have any cross-sectional shape that enables discharge electrode 56 to function as described herein. Moreover, it should be appreciated that angle $\alpha$ between pins 62 may be any angle $\alpha$ that enables discharge electrode 56 to function as described herein. Furthermore, it should be appreciated that although the exemplary embodiment describes pins 62 as having a length of approximately 1/1-2 inches, in other embodiments, pins 62 may have any length L that enables discharge electrode 56 to function as described herein.

Figure 6:
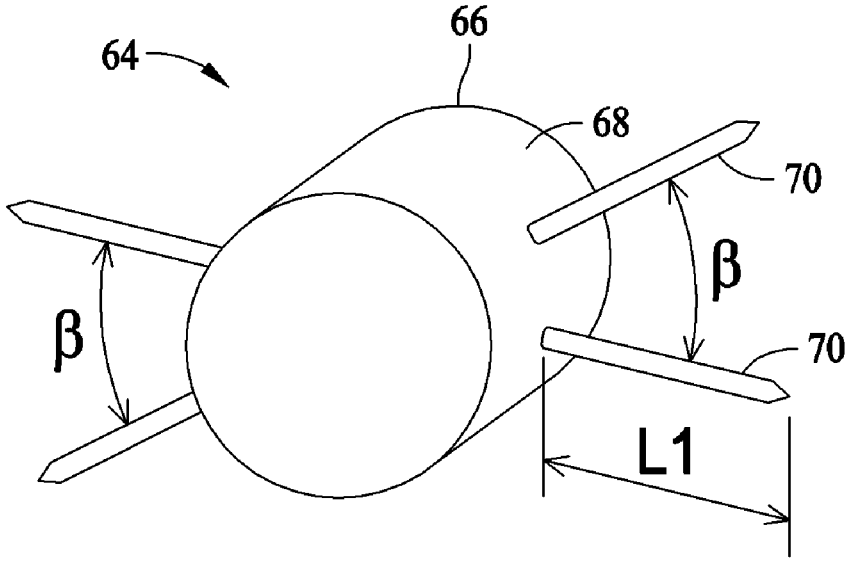
FIG. 6 is a perspective view of an exemplary V-pin discharge electrode.

FIG. 6 is a perspective view of an exemplary V-pin discharge electrode 64. More specifically, V-pin discharge electrode 64 includes a central discharge electrode body 66 having an outer surface 68 and four pins 70 extending radially outward therefrom. Electrode body 66 is cylindrically-shaped and has a substantially circular cross-section. Pins 70 have a length L1, are positioned in pairs about the periphery of outer surface 68, and extend radially outward from outer surface 68. Each pair of pins 70 includes two pins 70 separated at an acute angle $\beta$ about outer surface 68 such that each pair of pins 70 defines a generally V-shaped configuration. Moreover, each pin 70 included in each pair of pins, is diametrically opposed to another pin included in another pair of pins. It should be appreciated that although the exemplary embodiment is described as including an electrode body 66 having a substantially circular cross-section, in other embodiments, electrode body 66 may have any cross-sectional shape that enables discharge electrode 64 to function as described herein. Moreover, it should be appreciated that angle β between pins 70 may be any acute angle β that enables discharge electrode 64 to function as described herein. Furthermore, it should be appreciated that length L1 of pins 70 may be any length that enables discharge electrode 64 to function as described herein.

Figure 7:
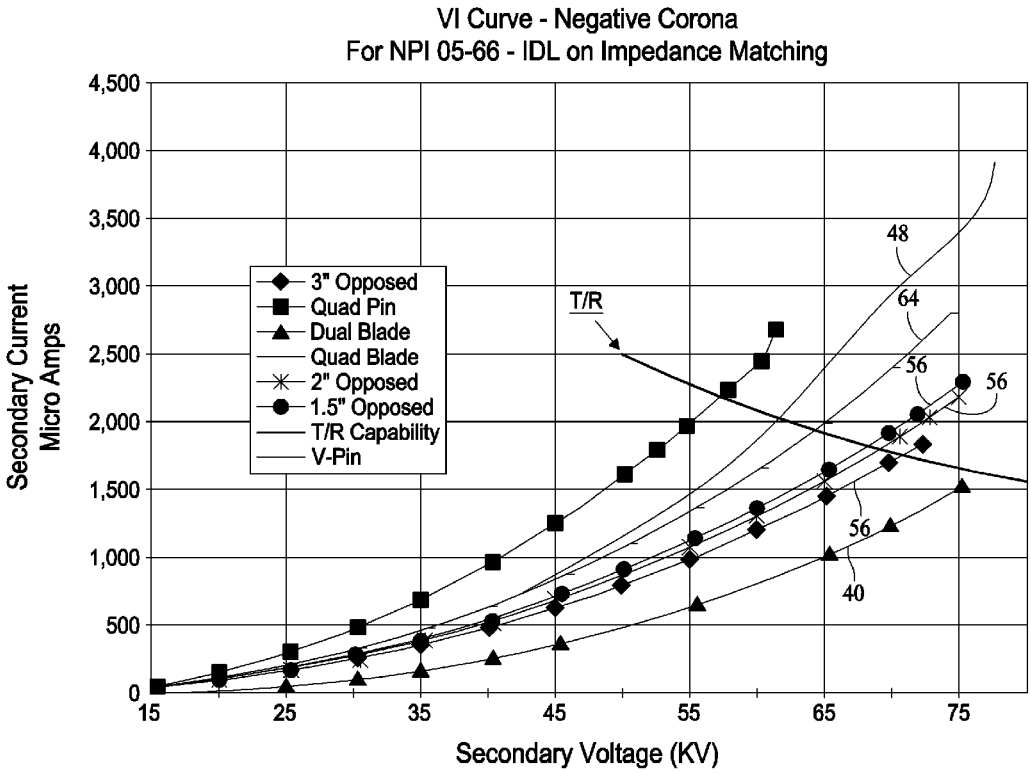
FIG. 7 is a graph of exemplary discharge electrode performance curves.

FIG. 7 is a graph showing exemplary curves of secondary voltage plotted against secondary current for a plurality of rigid discharge electrode 22 embodiments. These curves are known as V-I performance curves. More specifically, V-I curves are shown for dual blade discharge electrode 40, quad blade discharge electrode 48, opposed pin discharge electrodes 56 and V-pin discharge electrode 64. The V-I performance curve of dual blade discharge electrode 40 shows that providing dual blades in this configuration results in relatively low secondary current at an applied secondary voltage. The V-I performance graph for quad blade discharge electrode 48 shows that providing quad blades in this configuration results in relatively high secondary currents at an applied secondary voltage, versus dual blade discharge electrode 40.

The V-I performance graph of dual pin discharge electrode 56 shows that providing dual pins 62 in this configuration, and having a length L of 1-½ inches, facilitates providing secondary voltages and secondary currents intermediate those provided by dual blade electrode 40 and quad blade electrode 48. Modifying the length L of pins 62 alters the V-I performance of dual pin electrode 56. For example, by increasing the length L to two inches, dual pin electrode 56 provides marginally less secondary current at the same secondary voltage versus using L of 1-½ inches. By increasing length L to three inches, dual pin electrode 56 provides smaller corresponding secondary current than both 1-½ and 2 inch pins 62 at the same secondary voltage.

The V-I performance graph of V-pin discharge electrode 64 provides discharge electrode performance similar to quad blade electrode 48. However, starting at about a secondary voltage of about 45 kV V-pin electrode 64 provides increased secondary current for the same secondary voltage versus quad blade electrode 48.

It should be appreciated that each of the discharge electrode exemplary embodiments 40, 48, 56 and 64 described herein is based on empirical data reflecting process parameters, such as, but not limited to, precipitator configuration, particle resistivity and operating volume, as well as the V-I curve of an electric field and a transformer/rectifier's rating.

For low dust loading composed of primarily fine particles, discharge electrode 22 should be designed to maintain relatively high voltage to maintain adequate electric field strength without reaching a secondary current limit of the power supply. Thus, of the discharge electrode embodiments described herein, dual blade discharge electrode 40 is the most effective for removing fine particles from the fluid.

For heavy dust loading composed primarily of coarse particles, discharge electrodes 22 should be designed to produce high secondary current at an applied secondary voltage. This maximizes charging of the dust with the available electric field. Thus, of the discharge electrode embodiments described herein, quad blade discharge electrode 48 operates at a high secondary current with a minimal secondary voltage to provide the best charging, and is the most effective at removing coarse particles from the fluid.

V-I performance characteristics of discharge electrodes 22 may be used to determine their most effective location within precipitator 10. For example, the first electric field of precipitator inlets collects about eighty percent of the particles contained in the dust, and these particles are generally coarse. Consequently, positioning quad blade discharge electrodes 48 proximate precipitator inlet 14 facilitates optimizing coarse particle removal from the fluid. As another example, electric fields located downstream from the first electric fields encounter less dust than the first electric field and the dust generally contains finer particles. Consequently, positioning dual blade discharge electrodes 40 proximate precipitator outlet 16 facilitates optimizing fine particle removal from the fluid. The fluid in chamber 18 flowing from inlet 14 towards outlet 16 contains progressively fewer coarse particles and progressively more fine particles, on a percentage basis. Consequently, opposed pin discharge electrodes 56 designed to have pin lengths L corresponding to both coarse and fine particle removal, should be positioned proximate a center of chamber 18. Thus, electrostatic precipitators 10 may be designed to contain discharge electrodes 22 that are specifically positioned within precipitator 10 for facilitating optimal particle removal in a particular region of electrostatic precipitators 10.

Rigid discharge electrodes 22 operating at a high secondary current for a given secondary voltage should be positioned proximate precipitator areas containing heavy loading of coarse particles. Discharge electrodes 22 operating with high secondary current while maintaining adequate secondary voltage should be positioned proximate precipitator areas containing lower dust loading of fine particles. Discharge electrodes 22 with intermediate secondary voltage and intermediate secondary current should be positioned proximate precipitator areas containing a mix of coarse and fine particles. Thus, the electric fields of discharge electrodes 22 positioned proximate inlet 14 operate at the highest secondary voltage, and the electric fields of discharge electrodes 22 positioned downstream of the inlet operate at progressively lower secondary voltages and progressively higher secondary currents.

In each embodiment the above-described rigid discharge electrodes facilitate operating transformer/rectifiers closer to their maximum ratings. More specifically, in each embodiment, by modifying rigid discharge electrode geometry the relationship between the secondary voltage and the secondary current is modified such that V-I curves are designed to facilitate matching the impedance of the discharge electrode with its associated electric field, thus, optimizing the power input into the electric field. As a result, operating voltage is facilitated to be maximized, operating performance is facilitated to be improved and the cost of rebuilding electrostatic precipitators is facilitated to be reduced. Accordingly, electrostatic precipitator performance and component useful life are each facilitated to be enhanced in a cost effective and reliable manner.

Exemplary embodiments of rigid discharge electrodes are described above in detail. The rigid discharge electrodes are not limited to use with the specific precipitator embodiment described herein, but rather, the rigid discharge electrodes can be utilized independently and separately from other rigid discharge electrode components described herein. Moreover, the invention is not limited to the embodiments of the rigid discharge electrodes described above in detail. Rather, other variations of rigid discharge electrode embodiments may be utilized within the spirit and scope of the claims.

While the invention has been described in terms of various specific embodiments, those skilled in the art will recognize that the invention can be practiced with modification within the spirit and scope of the claims.

What is claimed is:

1. A method to facilitate improving electrostatic precipitator performance, said method comprising:

providing an electrostatic precipitator including an inlet, a collector chamber and an outlet, wherein the collector chamber includes a plurality of discharge electrodes and a plurality of collector electrodes;

defining a respective discharge electrode V-I performance for each of the plurality of discharge electrodes;

identifying a particle removal characteristic for each respective discharge electrode based on the respective discharge electrode V-I performance for each of the plurality of discharge electrodes; and positioning each of the plurality of discharge electrodes in the electrostatic precipitator according to the particle removal characteristic for each respective discharge electrode.

2. A method in accordance with claim 1 wherein defining a respective discharge electrode V-I performance for each of the plurality of discharge electrodes further comprises altering a geometry of each discharge electrode to modify a relationship between a secondary voltage and a secondary current.

3. A method in accordance with claim 1 wherein identifying a particle removal characteristic for each respective discharge electrode further comprises identifying fine particle removal with a discharge electrode that operate at a voltage without reaching a secondary current limit of a power supply.

4. A method in accordance with claim 1 wherein identifying a particle removal characteristic for each respective discharge electrode further comprises identifying coarse particle removal with a discharge electrode that operates at a secondary current for an applied secondary voltage.

5. A method in accordance with claim 1 wherein positioning each of the plurality of discharge electrodes in the electrostatic precipitator further comprises positioning discharge electrodes proximate the electrostatic precipitator inlet that operate at a voltage without reaching a secondary current limit of a power supply.

6. A method in accordance with claim 1 wherein positioning each of the plurality of discharge electrodes in the electrostatic precipitator further comprises positioning discharge electrodes proximate the electrostatic precipitator inlet that operate at a secondary current at an applied secondary voltage.

7. A method in accordance with claim 1 wherein defining a respective discharge electrode V-I performance for each of the plurality of discharge electrodes further comprises modifying a relationship between a secondary voltage and a secondary current by changing a length of pins extending from a body of one of the plurality of discharge electrodes.

8. A method in accordance with claim 1 wherein defining a respective discharge electrode V-I performance for each of the plurality of discharge electrodes further comprises modifying a relationship between a secondary voltage and a secondary current by changing a number of blades extending from a body of one of the plurality of discharge electrodes.

9. A system for improving electrostatic precipitator performance, said system comprising:

an electrostatic precipitator comprising an inlet, an outlet and a collector chamber extending between said inlet and said outlet, said collector chamber includes a plurality of discharge electrodes and a plurality of collector electrodes; and a respective discharge electrode V-I performance, related to a respective discharge electrode geometry associated for each of said plurality of discharge electrodes, each of said discharge electrode V-I performances is used to identify a particle removal characteristic for each respective discharge electrode, each of said plurality of discharge electrodes is positioned in said electrostatic precipitator based on said particle removal characteristic for each respective discharge electrode.

10. A system in accordance with claim 9 wherein said respective discharge electrode geometry defines a relationship between a secondary voltage and a secondary current.

11. A system in accordance with claim 9 wherein each of said particle removal characteristics includes at least one of fine and coarse.

12. A system in accordance with claim 9 wherein each one of said plurality of discharge electrodes operate with a high voltage without reaching a secondary current limit of a power supply to facilitate removing fine particles from said electrostatic precipitator.

13. A system in accordance with claim 9 wherein each of said plurality of discharge electrodes operates with a high secondary current for an applied secondary voltage to facilitate removing coarse particles from said electrostatic precipitator.

14. A system in accordance with claim 9 wherein at least one of said plurality of discharge electrodes operates with a high voltage without reaching a secondary current limit of a power supply and is positioned proximate said electrostatic precipitator outlet and at least one of said plurality of said discharge electrodes operating with a high secondary current at an applied secondary voltage is positioned proximate said electrostatic precipitator inlet.

* * * * *